US006345584B1

(12) United States Patent
Mascellaro

(10) Patent No.: US 6,345,584 B1
(45) Date of Patent: Feb. 12, 2002

(54) HULL FOR SHIPPING WITH A MONO-THREE-CATAMARAN ARCHITECTURE

(76) Inventor: Luigi Mascellaro, Via Fosso della Castelluccia, 146/22 00134, Rome (IT)

( * ) Notice: Subject to any disclaimer, the term of this patent is extended or adjusted under 35 U.S.C. 154(b) by 0 days.

(21) Appl. No.: 09/674,731

(22) PCT Filed: Apr. 22, 1999

(86) PCT No.: PCT/IT99/00101

§ 371 Date: Nov. 6, 2000

§ 102(e) Date: Nov. 6, 2000

(87) PCT Pub. No.: WO99/57006

PCT Pub. Date: Nov. 11, 1999

(30) Foreign Application Priority Data

May 6, 1998 (IT) ..... RM98A0294
Jan. 14, 1999 (IT) ..... RM99A0024

(51) Int. Cl.[7] ..... B63H 1/32
(52) U.S. Cl. ..... 114/290; 114/61.21; 114/62
(58) Field of Search ..... 114/61.1, 61.2, 114/61.21, 288, 290, 67 A, 289, 62

(56) References Cited

U.S. PATENT DOCUMENTS

| | | | | |
|---|---|---|---|---|
| 450,350 A | * | 4/1891 | Bruce, Jr. | |
| 911,806 A | * | 2/1909 | Broward | |
| 1,042,636 A | * | 10/1912 | Apel | |
| 2,735,392 A | | 2/1956 | Cox | |
| 5,402,743 A | * | 4/1995 | Holderman | 114/62 |
| 5,544,609 A | | 8/1996 | Miller | |

FOREIGN PATENT DOCUMENTS

| | | | |
|---|---|---|---|
| DE | 41 27 939 | | 3/1993 |
| DE | 195 38 563 | | 4/1996 |
| FR | 1 169 344 | | 12/1958 |
| FR | 1 246 011 | | 2/1961 |
| FR | 2 604 412 | * | 4/1988 |
| GB | 1 545 900 | | 5/1979 |
| NL | 11 470 | | 8/1924 |

* cited by examiner

*Primary Examiner*—Sherman Basinger
(74) *Attorney, Agent, or Firm*—Young & Thompson

(57) ABSTRACT

A hull for shipping with a mono-three-catamaran architecture comprises a bow point (11) connected to hull sides (14, 15) that ends at a stern (12); a pair of chines (17, 18) disposed laterally to a center line (X—X), a keel (13) extending along the center line (X—X) on the underside of the hull aftward from the bow point (11) for a length less than the distance between the bow point (11) and the midship section (5); a bottom (16) extending laterally between the chines (17, 18), and between every chine (17, 18) and the keel (13), where the keel (13) is present, forming inverted longitudinal bottom channels (26, 27).

6 Claims, 5 Drawing Sheets

A
B
C
D
0
1
2
3
4
5
6
7
8
9
10
11
12
13
14
15
16
17
18
19
20
21
22
23
24
25
29

HULL FOR SHIPPING WITH A MONO-THREE-CATAMARAN ARCHITECTURE

BACKGROUND OF THE INVENTION

This invention relates to a hull for shipping with a mono-three-catamaran architecture.

The total resistance to forward motion of a boat is basically the sum of the skin friction (that is obtained by integrating the tangential stress over all the hull surface in the direction of the motion), the viscous drag (that is connected to the energy dissipated owing to the viscous effects) and the residual resistance. The residual resistance includes to a great extent the wave resistance, that is connected to the energy dissipated by the hull in making gravitational waves.

A hull moving forward generates a global wave formation, that is constituted in turn by two distinct but interacting wave systems: a diverging wave system and a transverse wave system. The global wave formation is contained inside two lines, that are called boundary lines of the diverging wave system. Each boundary line forms an angle of 19.5 degrees with the longitudinal symmetry plane of the hull. The crest lines of the transverse waves are perpendicular to the direction of the hull motion near the hull and turn backward as the transverse waves approach the diverging waves until they join the same diverging wave system. In front of the bow of the ship there is a high pressure area that generates a prominent wave front as a part of the transverse and diverging wave system. Further wave systems form near the bow and stern sides of the hull.

A resulting wave system may be often considered as formed by four wave systems:

- a bow wave system owing to the high pressure area that forms near the bow during the forward motion of the hull;
- a wave system forward from the bow side portion owing to a low pressure area that forms near such a side portion;
- a wave system that forms along the stern side portion owing to a low pressure area existing in such a part of hull;
- a stern wave system owing to a high pressure area that forms in the stern area.

It is very difficult to foresee the exact position of the crest of both the bow wave and stern systems. It is likewise difficult to foresee the position of the troughs of the wave systems formed in the bow and stern side portions of the hull owing to high pressure peaks that are generated near said bow and stern side portions.

Said four wave systems that form the global wave system can interfere with each other in a more or less favorable manner for the resistance to forward motion of the hull. However, since the wave resistance contributes to the total resistance to a great extent, one should act just on the wave resistance by taking measures intended to reduce said wave resistance so that the propulsive power installed on a boat may be decreased, with the speed reached by the boat being the same.

In the last years the designers have had as a goal to reduce as much as possible the wave formation generated by the hull moving forward.

On the other hand, there are designs that improve the conditions of resistance to forward motion by utilizing the bow wave formations, holding in the same in the bottom of the hull and creating a more prominent resulting stern wave system. Among others, U.S. Pat. No. 5,402,743 issued on Apr. 4, 1995 to Holderman and entitled "Deep Chine Hull Design", discloses a hull with a bottom structure forming two longitudinal channels which extend fore and aft along all the hull. In the above patent, the bow wave, being assisted in its rotatory motion and controlled in a certain measure, deviates into these channels. The bow wave is controlled through the conformation of said channels according to a Venturi tube. The inventor of the above patent makes it a condition, among the other things, that air in the bow of the hull is thrown out before being included inside the same channels. Further, this condition sets limits on the shape of the hull that must have curved sides, i.e. the hull is tapered in its cross sections toward the bow and toward the stern, and accomplishes a Venturi tube structure along all its length through a pair of inverted channels that border a continuous keel fore and aft.

BRIEF SUMMARY OF THE INVENTION

This invention is close to the above patent only in the insight of diverting under the hull the bow wave formed in the forward motion.

However, differently from the above patent, an object of this invention is a hull, in which a portion of the energy spent to form the bow wave system is used to increase a hydrodynamic sustentation of the hull.

Another object of this invention is a hull in which the energy dissipated in both friction and viscous phenomena is reduced.

Furthermore, an object of this invention is a hull in which a resulting stern wave formation and then a dissipation energy connected therewith is limited.

Yet another object of this invention is a hull having a stability of shape whereby the hull goes steadily to a balance position whatever might be the speed of the shipping and, within limits, the conditions of the sea.

A further object of this invention is a hull having a length less than that of other hulls of shipping with equal carrying capacity.

For these purposes, the present invention provides a deep chine hull for shipping with a mono-three-catamaran architecture comprising:

- a bow point connected to hull sides lying in vertical parallel planes symmetrically opposed to a center line that ends at a stern;
- a pair of chines disposed laterally to the center line, each chine defining a lower edge of said hull sides, that begins at a desired cross section plane near the bow point under a waterline and thereafter defines a longitudinal line extending continually aftward to said stern;
- a keel, beginning near the bow point and extending along the center line on the underside of the hull aftward for a length less than the distance between the bow point and the midship section;
- a bottom extending laterally between said chines, and between every chine and said keel where the keel is present; a surface of the bottom having cross section planes at right angles with the center line forming convex bottom structures bridging a pair of inverted longitudinal bottom channels which extend laterally to said keel; said pair of channels merging aft from said keel with a single bottom channel having a profile with channel sides which are increasingly slanted in the stern cross sections and become parallel to the hull sides in the stern.

A hull so shaped according to the invention may be called a mono-three-catamaran.

Said bottom inverted structures have waterlines defining a bottom shaped as a diffuser with increased cross section areas, fore and aft, of said channel pair and of said single channel, in which the kinetic energy of the flow conveyed from bow is transformed into pressure energy.

Such a hull enables the energy dissipated in both friction and viscous phenomena to be reduced since air is conveyed under the hull inside the channels as above, not to create a continuous air layer and then use an over-craft effect, but to include air into water in order to carry on a boundary foamy layer. It is important to carry on a boundary foamy layer on the grounds of the following remarks:

i) if a continuous air layer is carried on, an optimal situation from the point of view of the reduction of the friction would be obtained; however, with the exception of a race-boat, the speed of the hull would not be high enough to compress the air layer to such an extent that the aerodynamic lift effect transferred to the hull is large;

ii) if the channel bottom surface is in direct contact with the water, there would be the best situation from a point of view of the hydrodynamic sustentation of a hull, but the worst from a point of view of the resistance to forward motion of a boat owing to an increase of the friction and viscous phenomena due to the widening of the wet surface;

iii) a foamy layer conciliates the need of decreasing as much as possible the friction resistance and the possibility of exploiting the hydrodynamic sustentation. Since the foam is constituted in general by very small spherical chambers containing air or gas (e.g. exhaust gas), the foam is rigid enough to allow a sufficient hydrodynamic sustentation to be transmitted with equal speed of the hull, against a reduced resistance to forward motion.

The foamy layer may be suitably obtained by conveying the bow waves, that are generated by both the keel and the chines, into the channels, and appropriately designing a propelling apparatus relating to both the choice and the arrangement thereof.

From the standpoint of the response of the hull according to the invention to the wave system generated when it is moving forward, the hull has a high pressure area in the bow in connection with the wave crest, a following low pressure area in connection with a wave trough and a subsequent low pressure area that would be formed aft from the keel beyond the point of maximum draft of the hull bottom. When the speed of the hull changes, the buoyancy center resulting from the pressure distribution above explained can fall fore or aft the center of gravity of the shipping. However, the longitudinal position of the hull may change only for a moment, since by changing the draft of the bow and the hull sides, the high pressure area and the following low pressure area would change as a consequence, resetting immediately the hydrodynamic balance. The greater or lower draft of the stern would change the cross sections of the effuser constituted by the ascending flat bottom aft from the keel, together with the internal sides of the chines, and would help to keep this balance. The flat bottom would function as a constant support for the hull. In conclusion, the hull according the invention "sails constantly on its wave", that is contained between its chines in the portion aft from the keel to the stern and guided in front by the stern and the keel.

Further, owing to the variation of pressure along the channels from the bow to aft of the keel, the water flow of the bow wave is subjected to a spiral right hand movement in the left channel and to a spiral left hand movement in the right channel, both helping the formation of air bubbles and increasing the foamy layer, with a reduction of the viscous friction.

One or two propulsors can change the pressure pattern under the hull, and then the position of the buoyancy center and the spiral movement above-mentioned.

The hull configured according to the present invention causes the bow wave formation so conveyed to give the hull back a portion of its energy in the form of an increase of the hydrodynamic sustentation. Further, a hull so configured allows, through both an appropriate selection of hull dimensions between its chines and a suitable arrangement of the propelling apparatus, the wave produced by the interaction of the wave systems generated in the motion of the boat to be controlled in its resulting height. This resulting height of the wave also depends on a dampening effect of said foamy layer.

Furthermore, the channel bottom surface, having convex cross sections as above, can be shaped so that the resultant of the thrust due to the hydrodynamic sustentation passes through the center of buoyancy approximately in order to not generate a trim variation both when the shipping is stationary or is navigating in a displacement way and when the shipping is navigating in a gliding way on its wave.

BRIEF DESCRIPTION OF THE SEVERAL VIEWS OF THE DRAWINGS

The invention will be better understood by reference to the following drawings, in which.

DETAILED DESCRIPTION OF THE INVENTION

Figures 1, 2, 3:
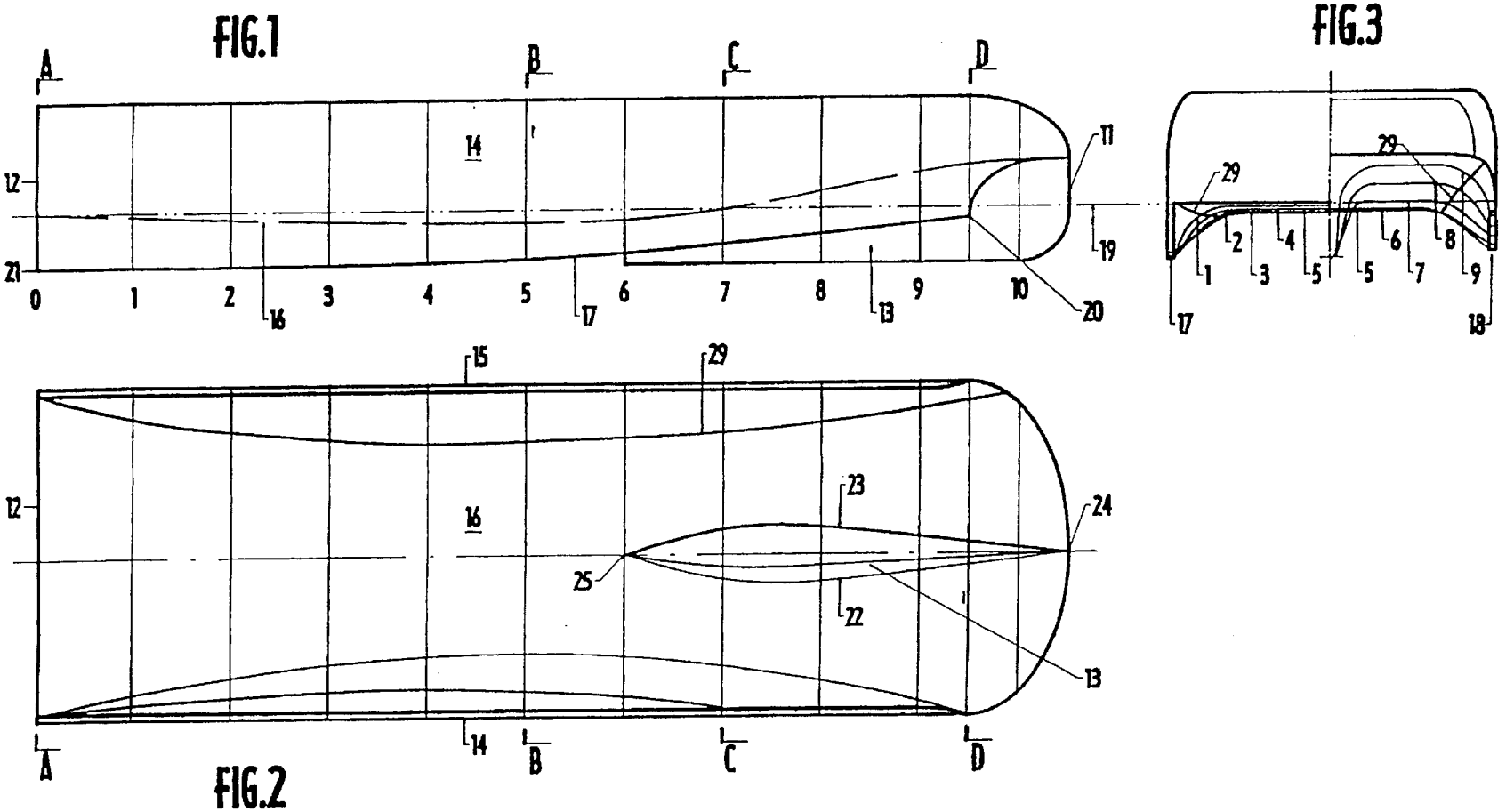
FIG. 1 is a side view of a first embodiment of a hull according to the invention.
FIG. 2 is a bottom view of the same hull of FIG. 1 with the top half showing the keel and the chine structure and the bottom half showing the waterlines.
FIG. 3 is a cross sectional view of the first embodiment of the hull of the invention showing each of nine stations.

Referring to the drawings of the first embodiment of the invention, FIGS. 1 and 2 show each of ten numbered vertical cross sections or positions. A hull of a shipping (also called "boat") according to the invention has a bow point 11 e.g. as a stem, a stern e.g. as a transom 12, a keel 13, hull sides 14 and 15, a bottom 16, chines 17 and 18. The chines 17 and 18 are the points where the sides 14 and, respectively, 15 meet the bottom 16. A stationary boat waterline is designed in 19.

As shown in FIGS. 1 to 3, the bow point 11 is connected convexly to the hull sides 14, 15 through convex shapes suitably connected. The hull sides 14, 15 lie in vertical, parallel planes, that are symmetrically opposed with respect to a diametral longitudinal plane shown in a center line X—X, and end aft at the stern 12. The stern 12 is flat. However, a boat stern may be differently shaped.

The hull sides 14 and 15 end downwards at the chines 17 and, respectively, 18, being disposed laterally to the diametral longitudinal plane and defining a lower edge of the same hull sides 14 and 15. Each chine 17, 18 begins in 20, in a cross section plane between positions 9 and 10, thereafter defines a longitudinal curve extending continually aftward to the stern 12 and ending in a point 21.

The keel 13 extends along the center line X—X on the underside of the hull fore and aft in a portion between the bow point 11 and a boat position 6. Preferably, the keel 13 is tapered downwards, having symmetrical biconvex contours 22 and 23, a leading-edge 24 and a trailing edge 25 both suitably connected. The biconvex contours 22 and 23 have the maximum chord in the second third of the length of the keel 13 from the bow point 11. However, this configuration may be varied in order to optimize design parameters. With regard to the position of the keel 13, it is suitable that its leading edge 24 is situated in the bow point 11 and its trailing edge 25 is situated in a cross section 6 ahead of the midship section 5 by about a tenth of the length of the shipping on the waterline. However, the position of the trailing edge 25 may be varied as required. In the embodiment shown the keel 13 has its lower end lying in a horizontal plane, where also the point 21 of the chines 17 and 18 lies. A different project might require either a greater or lower draft.

Figure 4A:
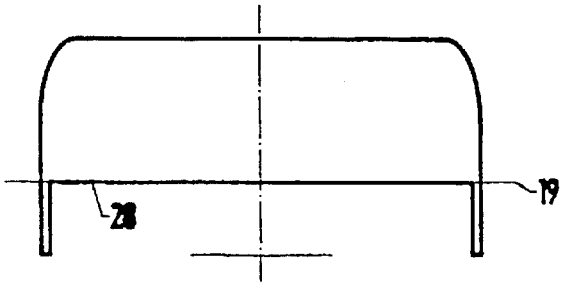
FIGS. 4A, 4B, 4C, 4D are cross sectional view of the first embodiment of the hull taken along lines A—A, B—B, C—C and, respectively, D—D in FIGS. 1 and 2.
Figure 4B:
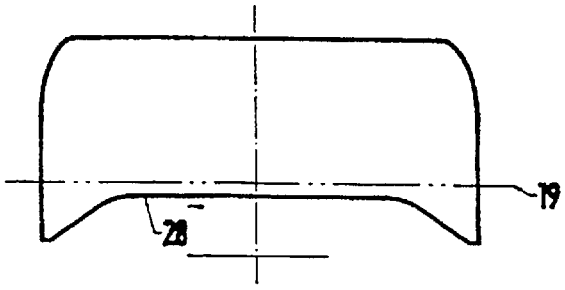
Figure 4C:
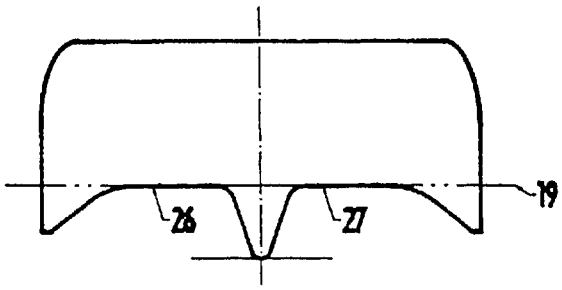
Figure 4D:
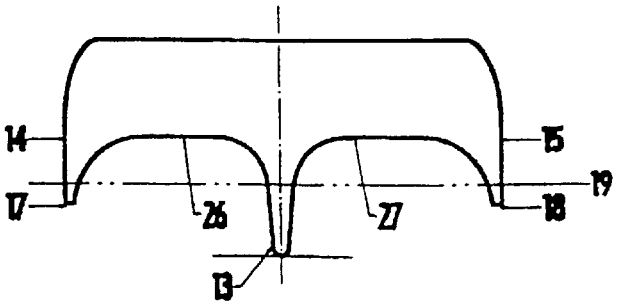

The bottom 16, i.e. the underside of the hull according this invention, has a surface extending laterally between the chines 17 and 18 in the portion between the cross sections 0 to 6 and between each chine 17 and 18 and the keel 13 between the cross section 6 and the bow point 11. The surface of the bottom 16 has cross section planes at right angles with the center line X—X, the cross section planes forming convex bottom structures bridging the chines 17 and 18 and the keel 13. These convex bottom structures define a pair of inverted longitudinal channels 26 and 27 extending along both contours 22 and 23 of the keel 13. As shown in FIG. 4D, each longitudinal channel 26, 27 has a profile with channel sides deeply rockered near the bow in the beginning point 20 of the chines 17, 18. Aftward, e.g. as shown in FIG. 4C, the sides of the convex bottom channels are inclined angularly with a less steep ramp in the external channel side with respect to channel side defined by the keel 13. In the section C—C the bottom of the channels 26 and 27 merges into a single inverted convex bottom channel 28 aft from the keel. As shown in FIG. 4B, the channel 28 has a profile with ever more inclined angularly connected channel sides in the cross section toward stern. In the stern 12, the channel sides become parallel to the hull sides 14 and 15 and then at right angles with the bottom 16.

Referring to FIGS. 2 and 3, a locus of greatest curvature of the bottom channel sides is indicated in 29. The bottom 16 is so shaped to have a progressive cross section increase from stem to stern, first of the pair of channels 26 and 27 and then of the single channel 28.

Thus the object of limiting the formation of the bow wave system generated by the penetration of the keel in its motion into calm water is achieved. Said wave system is conveyed between the two hull sides 14 and 15 dipping under the waterline 19 at a suitable distance from the bow point 11.

Referring now to FIGS. 5, 6, 7, 8, 9E,F,G,H,I a second embodiment of the hull having a mono-three-catamaran architecture is shown. In figures similar parts to those of the first embodiment shown in FIGS. 1 to 4D are denoted by similar reference numerals.

Figure 5:
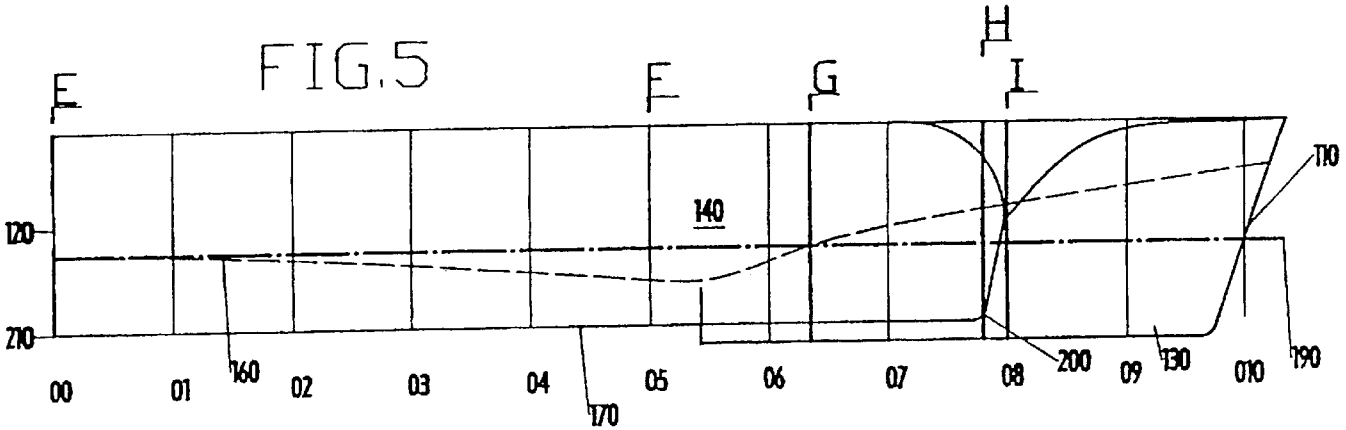
FIG. 5 is a side view of a second embodiment of a hull according to the invention.
Figure 6:
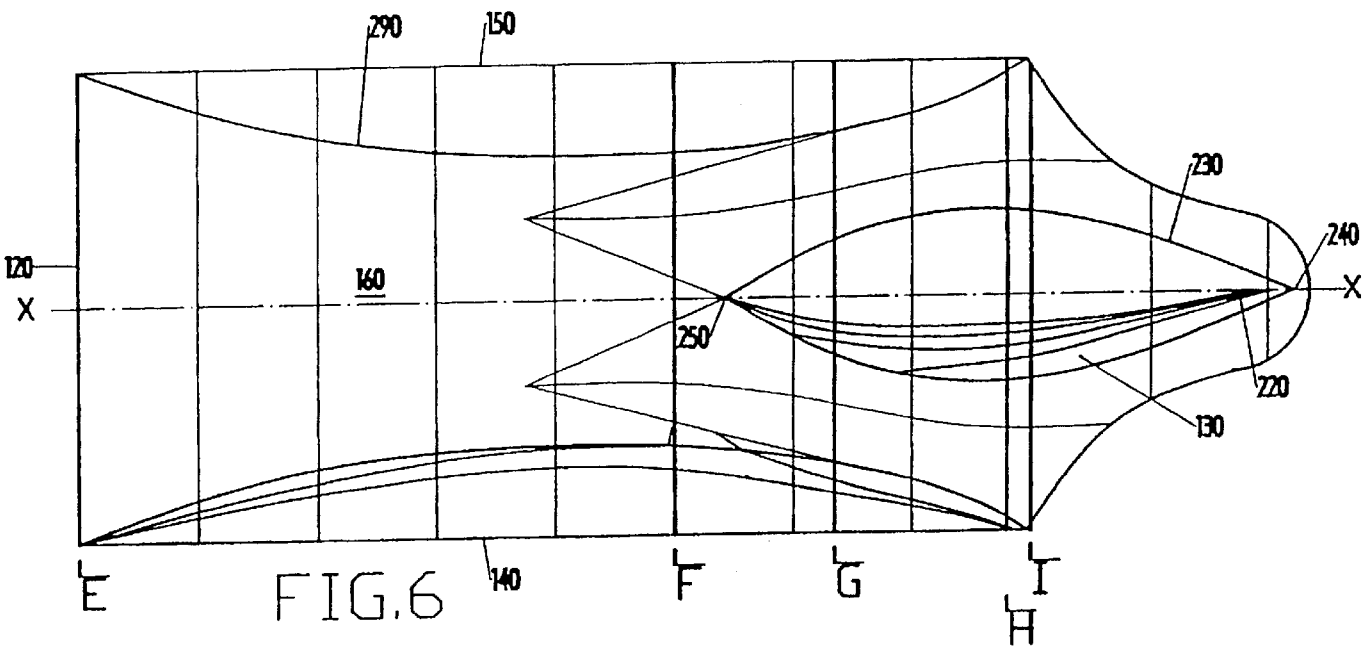
FIG. 6 is a bottom view of the same hull of FIG. 5 with the top half showing the keel and chine structure and the bottom half showing the waterlines.
Figure 7:
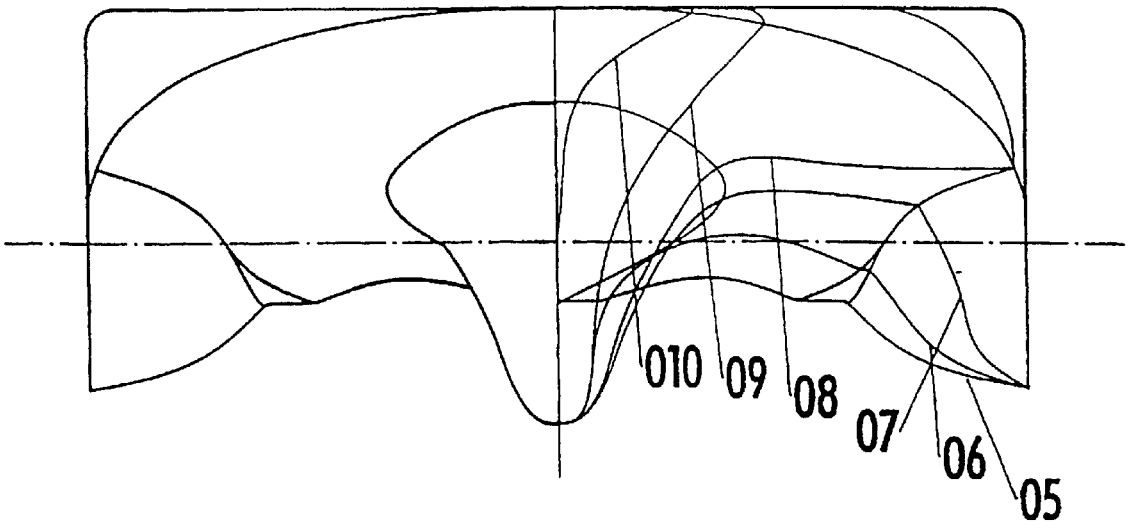
FIGS. 7 and 8 are cross sectional views of the second embodiment of the hull of the invention showing each of ten stations.
Figure 8:
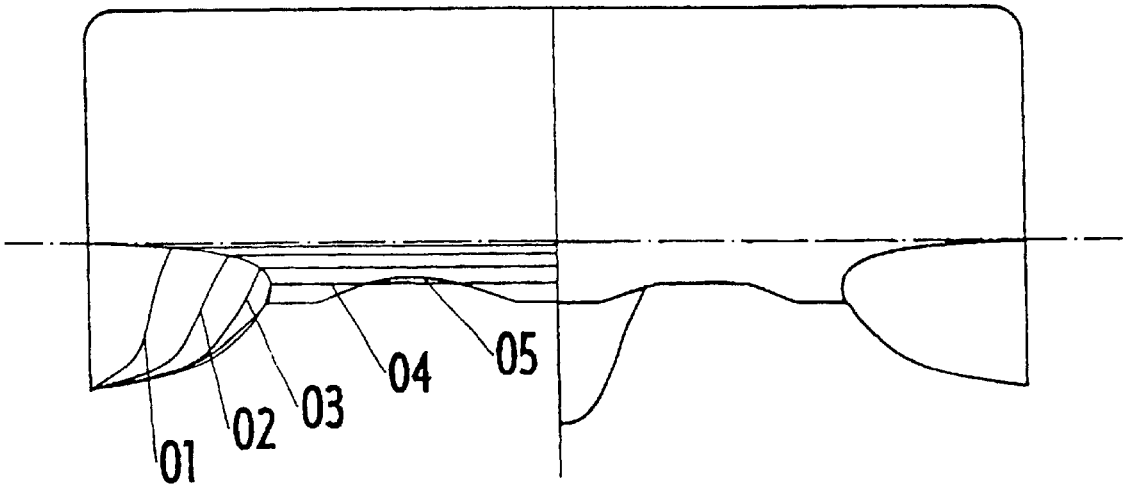

As shown in FIGS. 5 to 7, hull sides 140, 150, similarly to the first embodiment, lie in vertical, parallel planes, that are symmetrically opposed with respect to a diametral longitudinal plane shown in a center line X—X. However, bow point 110 is connected in front convexly and then concavely to the hull sides 140, 150, with a consequence that a bow portion extends more widely than in the hull of the first embodiment.

The hull sides 140 and 150 end downwards at chines 170 and, respectively, 180, beginning in 200, in a cross section plane aft the position 08 (FIG. 5), thereafter the chines 170, 180 define a longitudinal line extending continually aftward to the stern 120 and ending in a point 210. The function of such a widened bow portion will be explained below.

The keel 130 extends along the center line X—X on the underside of the hull fore and aft. Preferably, the keel 130 is tapered downwards, having symmetrical biconvex contours 220 and 230, a leading edge 240 and a trailing edge 250. The keel 130 has cross sections of a fusiform body.

The biconvex contours 220 and 230 have the maximum chord about in the midway of the length of the keel 130. With regard to the location of the keel 130, it is suitable that its leading edge 240 is situated near the bow point 110 and its trailing edge 250 is situated in a cross section between a cross section 06 and the midship section 05, before the last one by about a twentieth of the length of the shipping on the waterline. However, the position of the trailing edge 250 may be varied as required. In the second embodiment the keel 130 has its lower end lying in a horizontal plane, where also the point 210 of the chines 170 and 180 lies. A different project might require either a greater or lower draft.

Bottom 160, according to the second embodiment of this invention, has a surface extending between the chines 170 and 180 in the portion between the position 00 of the hull and the trailing edge 250 of the keel 130, between each chine 170 and 180 and the keel 130 in the portion between the trailing edge 250 and the position 08 of the hull, and toward the bow adjacent to the same keel.

The structures forming the bottom 160 define a pair of inverted longitudinal channels 260 and 270 extending along both contours 220 and 230 of the keel 130. As shown in FIG. 9I, each longitudinal channel 260, 270 begins with a profile with very flat channel sides. Aftward from position 08, as shown in FIG. 9H, the hull sides 140, 150 dive sharply and the chines 170 and 180 are immediately at their maximum draft. From cross section H—H to section G—G (FIG. 9G) the bottom bends down until the section of the trailing edge 250 of the keel and the sides of the convex bottom channels tend to be connected convexly on the external side with respect to the concave side defined by the keel 130. In the cross section of the trailing edge 250 the bottom 160 goes up again until the waterline 190 in the position 00. From the same cross section of the trailing edge 250 of the keel 130, the bottom of the channels 260 and 270 merges into a single inverted convex bottom channel 280.

Figure 9E:
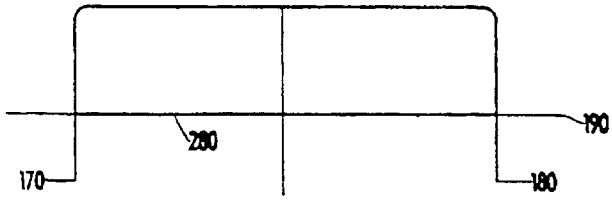
FIGS. 9E, 9F, 9G, 9H, 9I are cross sectional views of the second embodiment of the hull taken along lines E—E, F—F, G—G, H—H and, respectively, I—I in FIGS. 5 and 6.
Figure 9F:
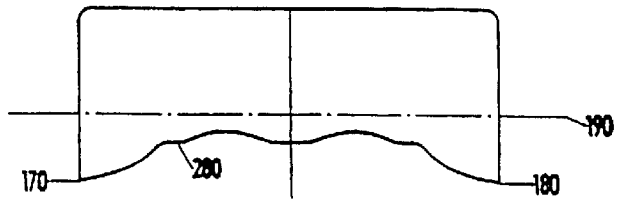
Figure 9G:
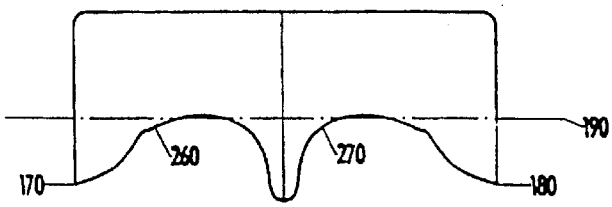
Figure 9H:
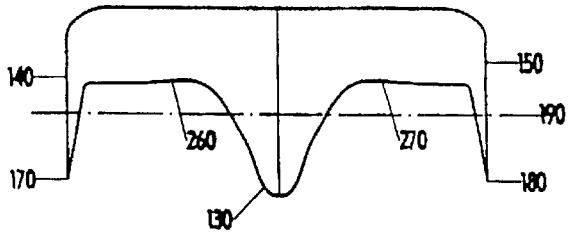
Figure 9I:
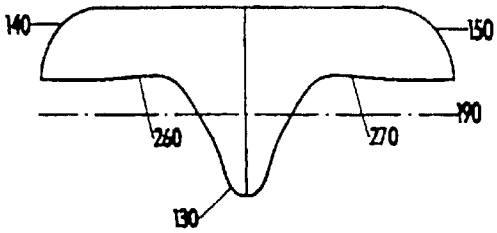

As shown in cross section G—G, FIG. 9G, the channel 280 has a profile with convex-flat-concave-flat sections until the center line. From the position 04 of the hull, the bottom is flattened going up and the sides of the bottom channel 280 are increasingly inclined to become parallel to the hull sides 140 and 150 and then at right angles with the bottom 160. Referring to FIGS. 5 and 6, a locus of greatest curvature of the bottom channel sides is indicated in 290.

In the second embodiment of this invention, the particular bottom profile with convex-flat-concave-flat sections serves to create discontinuity points for the pressure distribution in the underside of the hull, that give the hull a greater stability than that of the hull of the first embodiment.

Further, with respect to the first embodiment, the more elongated and flattened bow allows the bow wave to be directed, held by the sharply slanted downwards. The entrance of the channels 260 and 270 is much narrower with respect to the first embodiment, in virtue of the much more thickened edge of the keel 130 in the bottom 160. This increases the function of diffuser of the bottom of the hull. This configuration of the bow causes, in heavy sea, the bow wave to pass over the top of the bow so that the hull acquires a greater stability since the wave over the bow is balanced by hydrostatic thrust of the wave passing under the bow.

Such a structure permits that a hull may be developed for high speed, e.g. in a range between 15 and 25 knots.

Naturally also the hull sides according to the invention in the motion form their system of diverging and transverse bow waves. However, due to an asymmetry of said hull sides, in this bow wave system, the portion of waves moving away from the boat is of only slight importance, while the portion directed towards the center line is conveyed into the bottom channel, promoting the air-water inclusion and then the formation of the above described foamy layer.

Furthermore, the configuration of the bottom surface with two channels and a single channel aft from the keel, together with the formation of the foamy layer, enables a part of the energy spent in the formation of the bow wave system to be exploited as an increase of the hydrodynamic sustentation, as above-mentioned.

Yet, the configuration of the bottom surface with two channels and a single channel aft from the keel may be so made that the resultant of the thrust due to the hydrodynamic sustentation passes through the center of buoyancy approximately in order to not generate a trim variation both when the boat is stationary or is navigating in a displacement way and when the boat is navigating in a gliding way. In both situations the position of the boat is constant, i.e. with respect to bow-heavy or squat; when the boat begins to move, the only change in boat position is in the level of the waterline, that is lower.

Thanks to the greater stability than before, the pitching and then the risk of slamming, i.e. the impact of the bottom of a ship's bow hitting the water, is reduced. The pressure created under the bottom constitutes an obstacle for this known phenomenon that appears as a pressure wave reflected from shoals.

As above described, a hull so shaped promotes a decrease of the residual wave system after the transit of the boat, in virtue of the dampening effect of the foamy layer.

In order to increase both the consistency and the bulk of the foamy layer and help a water flow inside the bottom channels, it is suitable to locate a propulsor or more propulsors in the aft portion of the keel. Thus in addition to the above-mentioned effect of air-water inclusion, a suction phenomenon is created in the entrance of the channels in the bottom of the boat. This suction phenomenon prevents the water flow from blocking, which would cause a decrease of the foamy layer and then an uncontrolled increase of the resistances to forward motion.

A propulsor located under the bottom of the boat as above-mentioned, enlarging a low pressure area in the entrance of two bottom channels, helps waves to flow and then favours a navigation in rough sea condition.

With respect to the propulsor it would be noted that for medium tonnage shipping the propulsor may be suitably a jet drive having ramming intake located in bottom channels between the keel and the hull sides so to favour the suction effect, i.e. the depression in the bow entrance. The exit of the jet drive may be suitably located just aft the keel so to favour on one hand the formation of the foamy layer as above described and to increase on the other hand the speed in the single bottom channel between two hull sides with a consequent increase of the hydrodynamic sustentation and of water flow rate through the same channel.

In higher tonnage shipping one or more propellers may be placed also aft the keel with the same effects on water flow and then on the efficiency of the shipping.

When the propulsor is a sail, the central keel has a great draft and owing to low potential speed the shape of the keel may have in its low portion a wing profile at right angles with the keel in the aft portion thereof. The bottom side of the wing profile is almost flat while the upper side of the same is concave in order to promote the extension of the low pressure area toward stern, allowing the wave to easily overcome the hull bottom in the point of its maximum draft.

Some advantages of the invention can be resumed as follows. One of these advantages is a larger versatility in designing than before, i.e. the hull may be developed for wider speed ranges.

Furthermore, a mono-three-catamaran hull, as expressed by a neologism adopted in this specification has, in the performance with respect to the wave systems, advantages of the three architectures: mono-hull, catamaran and three-maran. The hull according to the invention neither behaves as a supported beam on the waves as the mono-hulls, nor is subjected to torsional stresses as typical for the multi-hulls, that therefore are limited in their possibilities and carrying capacities. Then, the mono-three-catamaran architecture, although it is a mono-hull overcomes the structural drawbacks of the hulls above-mentioned, while it acquires their advantages with respect to the hydrodynamic performance.

What is claimed is:

1. Hull for shipping with a mono-three-catamaran architecture comprising:

a bow point (11; 110) connected to hull sides (14, 15; 140, 150) lying in vertical parallel planes symmetrically opposed to a center line (X—X) that ends at a stern (12; 120);

a pair of chines (17, 18; 170, 180) disposed laterally to the center line (X—X), each chine (17, 18; 170, 180) defining a lower edge of said hull sides (14, 15; 140, 150), that begins at a desired cross section plane near the bow point (11; 110) under a waterline (19; 190) and thereafter defines a longitudinal line extending continually aftward to said stern (12; 120);

a keel (13; 130), beginning near the bow point (11; 110) and extending along the center line (X—X) on the underside of the hull aftward for a length less than the distance between the bow point (11; 110) and the midship section (5; 05);

a bottom (16; 160) extending laterally between said chines (17, 18; 170, 180), and between every chine (17, 18; 170, 180) and said keel (13; 130) where the keel (13; 130) is present; a surface of the bottom (16; 160) having cross section planes at right angles with the center line (X—X) forming convex bottom structures bridging a pair of inverted longitudinal bottom channels (26, 27; 260, 270) which extend laterally to said keel (13; 130); said pair of channels (26, 27; 260, 270)

merging aft from said keel (13; 130) with a single bottom channel (28; 280) having a profile with channel sides which are increasingly slanted in the stern cross sections and become parallel to the hull sides in the stern (12; 120).

2. Hull for shipping according to claim 1, characterised in that each channel (26, 27) is connected by a curve from the bow point (11) to the hull sides (14, 15) until the beginning point of the chines (17, 18) in which each channel has a profile with deeply rockered channel sides; said channel sides in the cross sections toward the stern (12) being angularly connected by a ramp to a central flat portion.

3. Hull for shipping according to claim 1, characterised in that each channel (260, 270) is connected by a curve from the bow point (110) to the hull sides (140, 150) until the beginning point of the chines (170, 180) in which each channel has a profile with very steep channel sides; said channel sides in the cross sections toward the stern (120) being convexly connected to a central flat portion.

4. Hull for shipping according to claim 1, characterised in that said keel (13; 130) is tapered downwards, having symmetrical biconvex contours (22, 23; 220, 230), a leading edge (24; 240) and a trailing edge (25; 250).

5. Hull for shipping according to claim 4, characterised in that said biconvex contours (22, 23) having the maximum chord in the second third of the length of the keel (13) from the bow point (11).

6. Hull for shipping according to claim 4, characterised in that said biconvex contours (220, 230) having the maximum chord in the midway of the length of the keel (130).

* * * * *